United States Patent [19]

White

[11] 4,068,409

[45] Jan. 17, 1978

[54] ANTI-RACKING MEANS FOR DOORS

[75] Inventor: Clarence E. White, Kenosha, Wis.

[73] Assignee: White Welding and Mfg., Inc., Kenosha, Wis.

[21] Appl. No.: 754,579

[22] Filed: Dec. 27, 1976

Related U.S. Application Data

[62] Division of Ser. No. 565,750, April 7, 1975, Pat. No. 4,014,138.

[51] Int. Cl.[2] ..... E05C 7/02

[52] U.S. Cl. ..... 49/367; 49/396; 292/218

[58] Field of Search ..... 49/366–369, 49/396; 292/218, 281, 300, DIG. 29

[56] References Cited

U.S. PATENT DOCUMENTS

| | | | |
|---|---|---|---|
| 3,784,243 | 1/1974 | Pastra, Jr. | 49/366 X |
| 3,891,112 | 6/1975 | Lycett et al. | 49/367 X |
| 3,912,312 | 10/1975 | Cerutti | 292/218 |

FOREIGN PATENT DOCUMENTS

| | | | |
|---|---|---|---|
| 1,222,801 | 2/1971 | United Kingdom | 49/396 |

*Primary Examiner*—Kenneth Downey
*Attorney, Agent, or Firm*—Darbo & Vandenburgh

[57] ABSTRACT

A first bracket is secured to one of a pair of doors hinged to a door frame for closing the same; a second bracket is secured to the other of the pair of doors; and the brackets are disposed in overlapping relationship, and include means which are interengageable, when the doors are in closed position.

2 Claims, 19 Drawing Figures

3.
6.
5.
4.
7.
8.
82
86
30
98
62
32
84
96
122
118
88
100
46
40
42
44
124
128
90
120
116
132
108
126
134
94
112
66
114
64
102
68
92
130
38
24
74
70
78
72
80
76
60

30
38
32
106
128
88
86
94
100
96
90
82
116
62
98
84
126
42
124
46

126
124
64
112
92
94
86
82
118
88
116
62
90
120
98
84
100
96
128
132
110
106
30
38
32

60
64
76
72
70
78
74
68

10
144
30'
138
32'
10.
148
142
140
42'
46'
124'
124'
142
148
146
148
142
11.
144
11.
24'
20'
60'
60'

30'
32'
82'
138
140
146
144
84'
124'
42'
46'
124'

124'
64'
82'
146
142
148
140
142
138
148
144
84'
46'
124'
134'
30'
32'

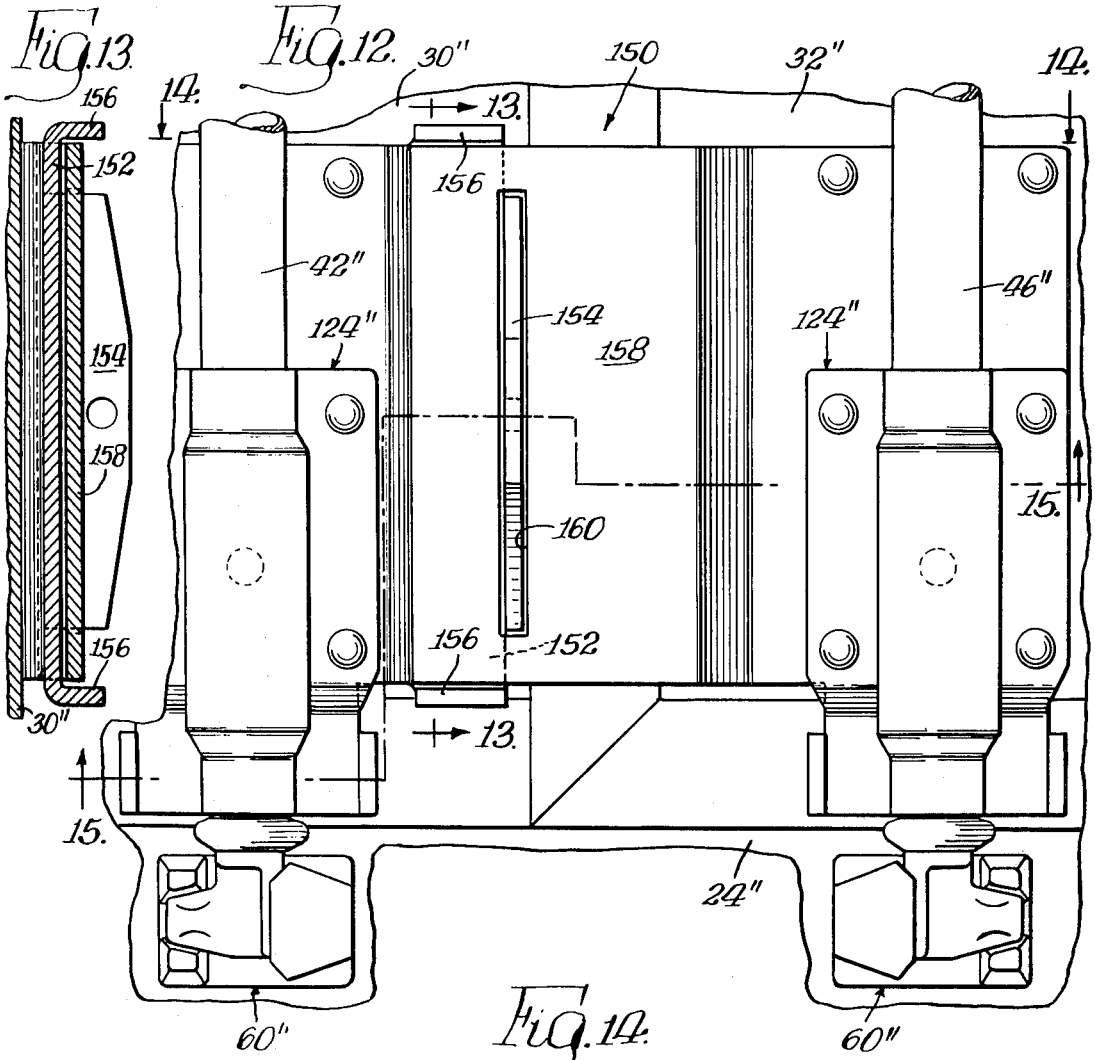
Fig. 13.
156
152
154
158
156
30"
Fig. 12.
30"
150
32"
14.
14.
13.
156
42"
46"
124"
154
158
124"
160
15.
156
152
13.
15.
24"
60"
60"
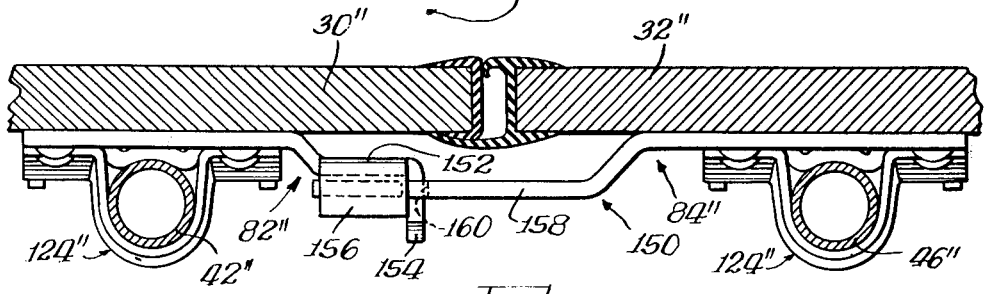
Fig. 14.
30"
32"
152
82"
156
160
158
84"
150
124"
42"
154
124"
46"
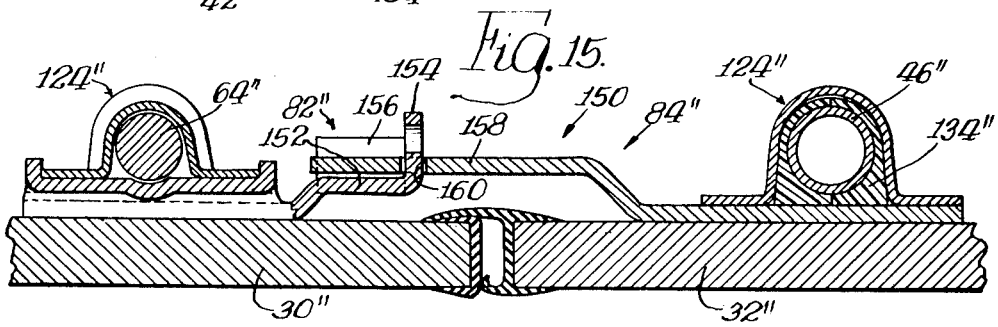
Fig. 15.
124"
64"
154
82"
156
152
158
150
84"
124"
46"
134"
160
30"
32"

ANTI-RACKING MEANS FOR DOORS

RELATED APPLICATION

This application is a division of my pending application Ser. No. 565,750 Filed Apr. 7, 1975 now U.S. Pat. No. 4,014,138.

BACKGROUND OF THE INVENTION

The present invention relates generally to antiracking means for the doors of large cargo containers and the like.

Large cargo containers and the like having enclosed bodies are conventionally provided with a rectangular door frame, a pair of doors which are adapted to be swung within the plane of the door frame for closing the latter, and rotary bar locking mechanism for selectively retaining the doors within the door frame. The door frame comprises horizontal top and bottom frame members and vertical side frame members suitably welded at their adjacent corner ends. For purposes of economy, the container (including the door frame) is usually fabricated of structural members having the least strength practical, and the doors are normally fabricated of plywood faced with an inner and an outer aluminum skin.

Because of the weakness of the structural members, the door frame is subject to considerable distortion when racking forces are applied to the container. The door frame is partially reinforced by the doors, and the frame and doors may be further reinforced by the rotary bar locking mechanism. However, such reinforcement has not been sufficient to withstand severe racking forces. For example, it has been observed that racking forces applied to the container diagonally at one corner of the door frame end tend to cause the top door frame member to assume a shallow sidewise S-curve with the maximum deflection occurring generally at the midpoint of the top frame member adjacent the gap of the doors. It has also been observed that such racking forces tend to cause an outward bowing of the vertical side frame members generally between the hinges.

SUMMARY OF THE INVENTION

It is an object of the present invention to provide anti-racking means for a cargo container and the like which will provide auxiliary reinforcement of the doors and the door frame, and which will minimize or wholly eliminate S-bending of the top frame member and bowing of the side frame members.

The anti-racking means of the present invention comprises a first bracket having a base portion secured to one of the doors and having a side portion adjacent the vertical free edge of the door, and a second bracket having a base portion secured to the other door and having a side portion adjacent the vertical free edge of the door. The side portions of the brackets are provided with interengageable means; and, when the doors are in closed position, the side portions are disposed in overlapping relationship and the interengageable means thereof are interengaged for reinforcing the doors and the door frame. Four embodiments of interengageable means, comprising some combination of tongues, pins, flanges and apertures, are disclosed herein.

In addition, the base portion of a bracket preferably is designed to serve as a backing plate for rotary door locking bar guide means, and slot means preferably is provided in the bracket for receiving a portion of the annular collar of a rotary door locking bar whereby axial racking forces imposed on the locking bar are transmitted through the bracket to the door.

BRIEF DESCRIPTION OF THE DRAWINGS

FIG. 12 is an elevational view of a further embodiment of anti-racking means of the present invention;

FIG. 13 is a vertical sectional view taken substantially along the line 13—13 in FIG. 12 looking generally in the direction indicated by the arrows;

FIG. 14 is a horizontal sectional view taken substantially along the line 14—14 in FIG. 12 looking generally in the direction indicated by the arrows;

FIG. 15 is a horizontal sectional view taken substantially along the line 15—15 in FIG. 12 looking generally in the direction indicated by the arrows;

DESCRIPTION OF THE PREFERRED EMBODIMENTS

Figure 1:
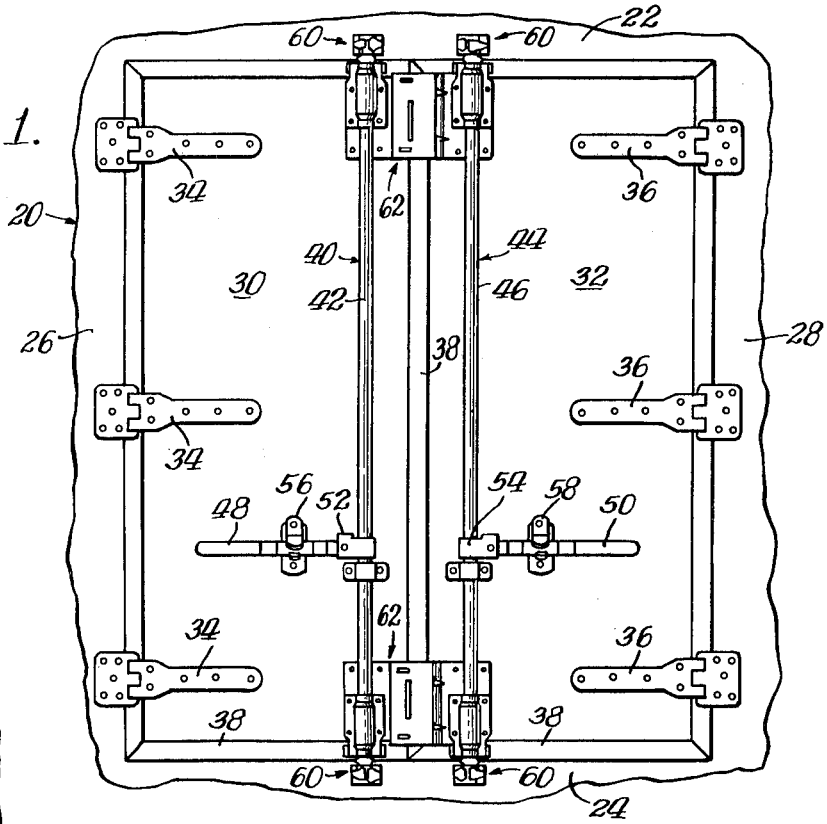
FIG. 1 is an elevational view of a door frame and a pair of doors with which one embodiment of the antiracking means of the present invention is incorporated.

Referring now to FIG. 1, there is indicated generally by the reference numeral 20 a conventional door frame which may, for example, be located at the rear end of the body of an enclosed cargo container. The door frame 20 comprises horizontal upper and lower structural elements 22 and 24 and vertical side structural elements 26 and 28. Disposed within the door frame 20 for closing the same are a pair of doors 30 and 32 which are vertically hinged to the side door frame elements 26 and 28 by means of hinges 34 and 36. To provide a suitable seal enclosure, resilient strip material 38 of general H-shaped cross sectional configuration may be secured about the edges of the doors 30 and 32, with the strip material along the vertical free edge of the door 32 being arranged to overlap the vertical free edge of the door 30.

The door 30 is adapted to be secured within the door frame 20 by means of rotary bar door locking mechanism 40 comprising a vertically disposed rotary lock bar or rod 42, while the door 32 is adapted to be secured within the door frame 20 by means of rotary bar door locking mechanism 44 comprising a vertically disposed rotary bar 46. Means for rotating the locking bars 42 and 46 are provided in the form of revolvable elements or hand levers 48 and 50 pivotally mounted to brackets 52 and 54 secured to the bars 42 and 46 respectively. The hand levers 48 and 50 are normally retained in seal assemblies or retainer means 56 and 58. Arranged for association with each of the upper and lower ends of the rotary door locking bars 42 and 46 are keeper members 60 secured to the upper and lower door frame elements 22 and 24; and associated with the respective upper and lower pairs of end of the rotary bars 42 and 46 are combined anti-racking and rotary bar guide means 62.

Figure 4:
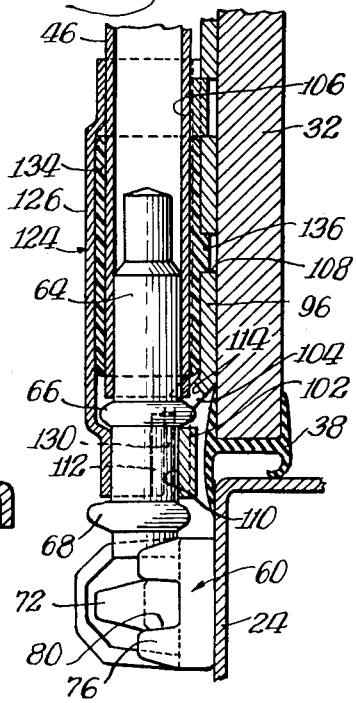
FIG. 4 is a vertical sectional view taken substantially along the line 4—4 in FIG. 2 looking generally in the direction indicated by the arrows.
Figure 5:
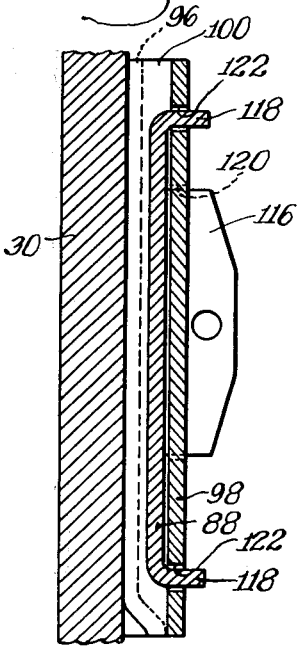
FIG. 5 is a vertical sectional view taken substantially along the line 5—5 in FIG. 2 looking generally in the direction indicated by the arrows.
Figure 2:
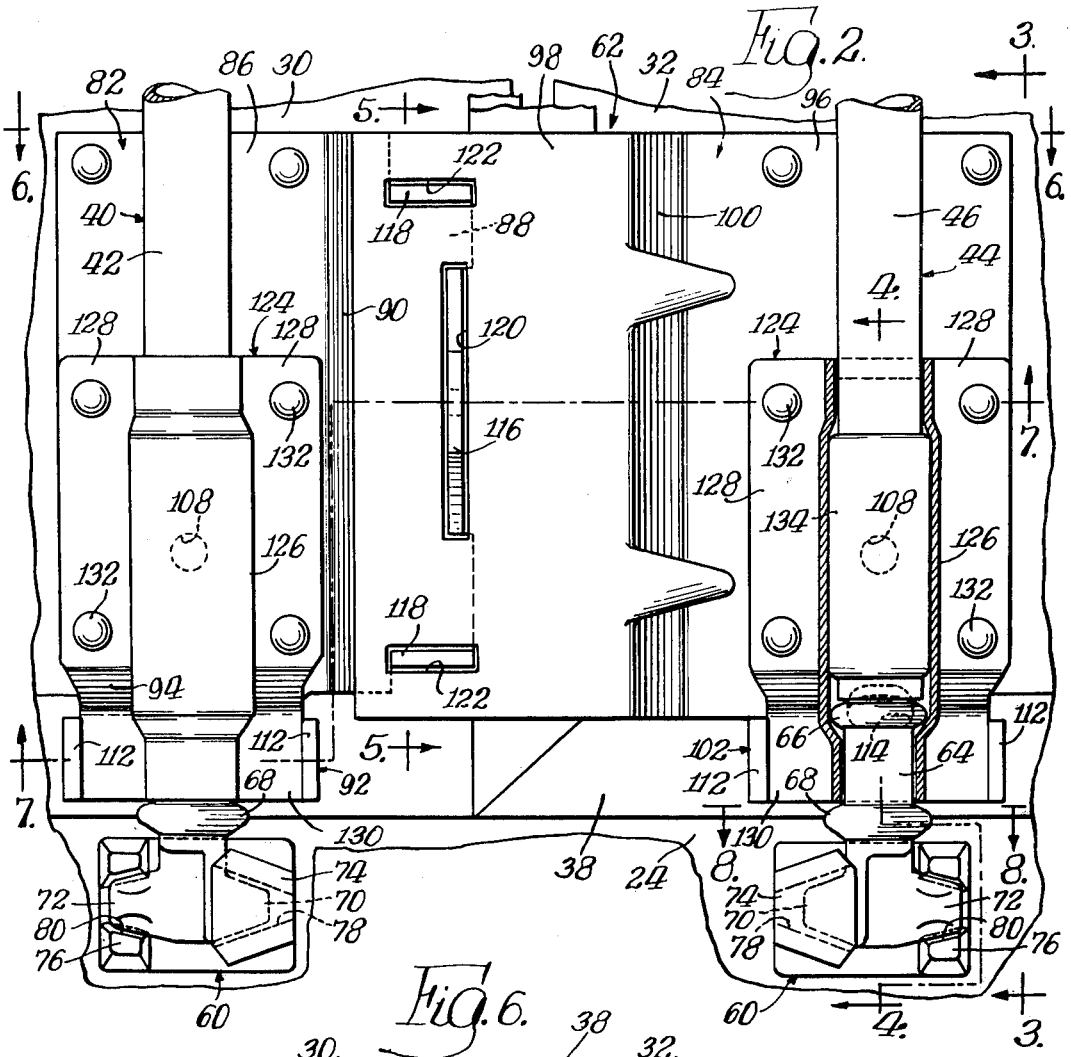
FIG. 2 is an elevational view, on an enlarged scale, of the anti-racking means of FIG. 1.
Figure 8:
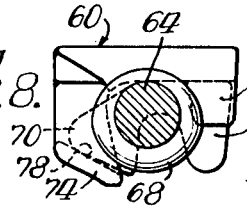
FIG. 8 is a horizontal sectional view taken substantially along the line 8—8 in FIG. 2 looking generally in the direction indicated by the arrows.

Each locking bar 42 and 46 has secured in each end thereof a bar end 64 (FIGS. 2, 4 and 8). Each bar end 64 includes a pair of axially spaced annular collars 66 and 68, and a pair of generally radially extending arm portions 70 and 72. Each keeper member 60 has laterally spaced forwardly extending projections 74 and 76. The projection 74 is formed with a lateral opening 78 therein, while the projection 76 is formed with a forwardly open recess 80 therein. The locking bar arm portions 70 and 72 are adapted to be engaged or received, respectively, in the lateral opening 78 and in the recess 80 of the adjacent keeper member 60.

Figure 3:
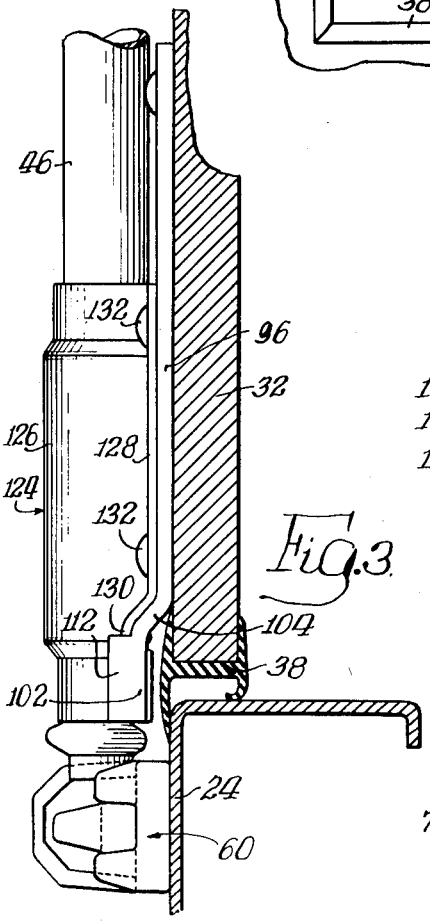
FIG. 3 is a vertical sectional view taken substantially along the line 3—3 in FIG. 2 looking generally in the direction indicated by the arrows.
Figure 6:
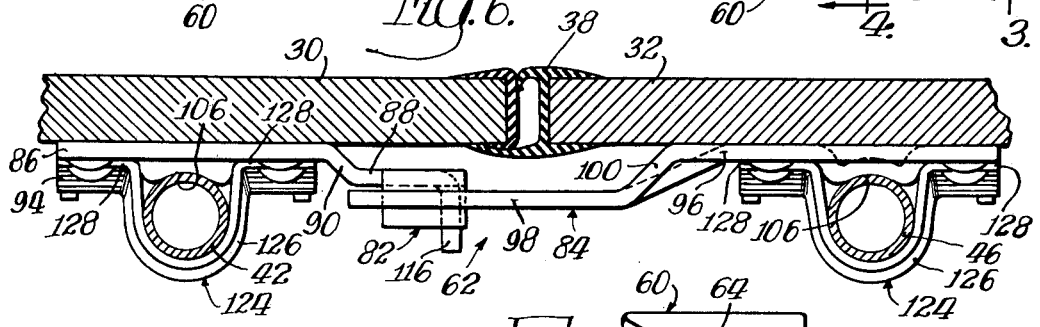
FIG. 6 is a horizontal sectional view taken substantially along the line 6—6 in FIG. 2 looking generally in the direction indicated by the arrows.

Each combined anti-racking and rotary bar guide means 62 (FIGS. 2, 6 and 7) comprises a pair of brackets 82 and 84. The bracket 82 includes a base portion 86 secured to the door 30, a forwardly offset side portion 88 adjacent the vertical free edge of the door 30 and joined to the base portion 86 by an inclined portion 90, and a forwardly offset end portion 92 adjacent the horizontal edge of the door 30 and joined to the base portion 86 by an inclined portion 94. Similarly, the bracket 84 includes a base portion 96 secured to the door 32, a forwardly offset side portion 98 adjacent the vertical free edge of the door 32 and joined to the base portion 96 by an inclined portion 100, and a forwardly offset end portion 102 adjacent the horizontal edge of the door 32 and joined to the base portion 96 by an inclined portion 104 (FIG. 3).

Figure 7:
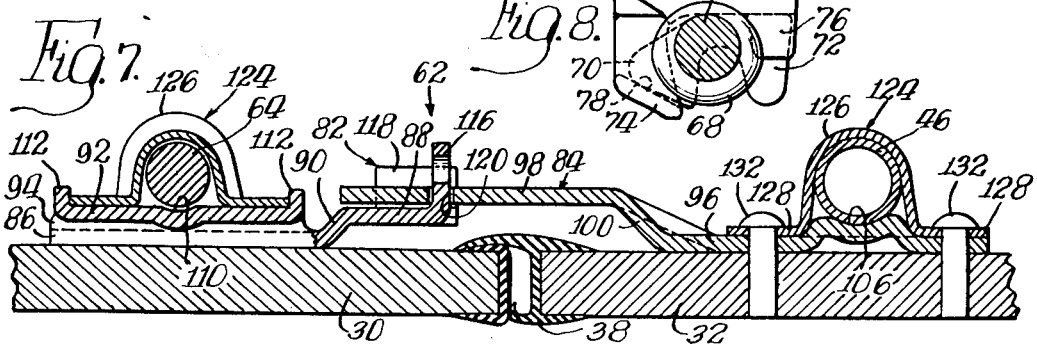
FIG. 7 is a horizontal sectional view taken substantially along the line 7—7 in FIG. 2 looking generally in the direction indicated by the arrows.

With the exception of the side portions 88 and 98, the brackets 82 and 84 are substantially identical in construction and configuration. For example, as shown in FIGS. 4 and 7, each base portion 86 and 96 is provided with an elevated arcuate bearing surface 106 and an intermediate bore 108; each end portion 92 and 102 is provided with a recessed arcuate bearing surface 110 and vertically oriented side flanges 112; and each inclined portion 94 and 104 is provided with a slot or notch 114. The brackets 82 and 84 differ in the configurations of the side portions 88 and 98. More specifically, the side portion 88 of the bracket 82 is formed with a central vertically oriented tongue or projection 116, and a pair of vertically spaced horizontally oriented tongues or projections 118, extending perpendicular to the plane of the door 30; while the side portion 98 of the bracket 84 is formed with a central vertically oriented aperture 120 adapted to receive the tongue 116, and a pair of vertically spaced horizontally oriented apertures 122 adapted to receive the tongues 118. The tongues 116 and 118 and apertures 120 and 122 constitute interengageable means.

Associated with each base portion 86 and 96 is a front guide plate or bearing bracket 124 characterized by a generally semi-cylindrical vertically disposed central portion 126 and a pair of side flanges 128. A portion of the side flanges 128 are forwardly offset, as at 130 (FIGS. 3 and 4), complementary to the offset bracket portion 92 and 102 and seated between the end portion side flanges 112 which serve to locate and prevent lateral movement of the front guide plate 124. The front guide plate side flanges 128 and the adjacent base portion 86 or 96 are suitably secured to the adjacent door by means of bolts 132. A vertically-split bearing 134 (FIG. 4) is mounted in each front guide plate 124 with a boss portion 136 of each half located in the base portion bore 108. The ends of the locking bars 42 and 46 are accommodated between the front guide plates 124 and the respective bracket base portions 86 and 96 which serve as backing plates, and are journaled in the bearings 134. The locking bar collars 68 bear against the end surfaces or abutments of the front guide plates 124 and the end surfaces or abutments of the respective bracket end portions 92 and 102. The locking bar collars 66 project into the bracket slots 114 immediately adjacent the surface (which forms an abutment) of forwardly offset portions 92 and 102. The locking bar collars 66 also are immediately adjacent the angular surface 135 (which forms an abutment) of front guide plate 124. Thus the arrangement of the collars and the abutments or surfaces axially restrain the locking bars 42 and 46 and portions of any axial racking forces exerted on the ends of the locking bars 42 and 46 are transmitted through the associated hardware to the doors 30 and 32.

To unlock the door 32, the hand lever 50 is released from the seal assembly 58 and swung in a horizontal plane from the position shown in FIG. 1 toward a forwardly extending position so that the bar 46 and arm portions 70 and 72 are caused to rotate. As the arm portions 70 and 72 are thus rotated, the arm portions 72 are moved outwardly of the recesses 80 in the top and bottom keeper members 60 and the arm portions 70 are withdrawn from the openings 78. Thereafter, the door 32 may be swung outwardly of the plane of the door frame 20 to an open position, while the bracket apertures 120 and 122 are disengaged from the bracket tongues 116 and 118. The door 30 may be unlocked and opened in a corresponding manner.

In closing the door 30, it is first swung to a position generally in the plane of the frame 20. The hand lever 48 is then pivoted from a forwardly extending position toward the position shown in FIG. 1 whereupon the bar 42 is rotated for causing the arm portions 70 to enter the openings 78 in the top and bottom keeper members 60 and for causing the arm portions 72 to be engaged in the recesses 80. After the arm portions 70 and 72 have been disposed in full locking engagement with the keeper members 60, the hand lever 48 is secured within the seal assembly 56. The door 32 may be closed and locked in a corresponding manner. As the door 32 is being locked, the bracket side portions 88 and 98 are disposed in overlapping relationship, and the bracket apertures 120 and 122 are interengaged with the bracket tongues 116 and 118. The interengaged tongues and apertures thereafter reinforce the doors and door frame thus resisting racking forces imposed thereon, and minimize or wholly eliminate S-bending of the upper structural element 22 and bowing of the side structural elements 26 and 28. The vertically disposed tongues 116 primarily serve to resist the vertical component of racking forces, while the horizontally disposed tongues 118 primarily serve to resist the horizontal component of racking forces.

For maximum anti-racking effect, combined antiracking and rotary bar guide means 62 are mounted adjacent the top and bottom of the doors 30 and 32. When maximum resistance to racking forces is not essential, a single combined anti-racking and rotary bar guide means 62 may be mounted adjacent the top of the doors, or adjacent the bottom of the doors, or at the midpoint of the doors. As disclosed herein, the base portion 86 and 96 of each cooperating pair of brackets 82 and 84 replaces the backing plate of conventional rotary bar guide means. When economy is not a prime consideration, the anti-racking brackets 82 and 84 may be mounted on doors having rotary bar guide means with independent conventional backing plates. For further details concerning the construction and operation of the keeper members 60 and the cooperating lock bar arm portions 70 and 72, reference may be had to U.S. Letters Pat. No. 3,212,805, issued on Oct. 19, 1965 to Roland J. Olander; and for further details concerning conventional rotary bar guide means, reference may be had to U.S. Letters Pat. No. 3,756,671, issued on Sept. 4, 1973 to Clarence E. White.

Figure 9:
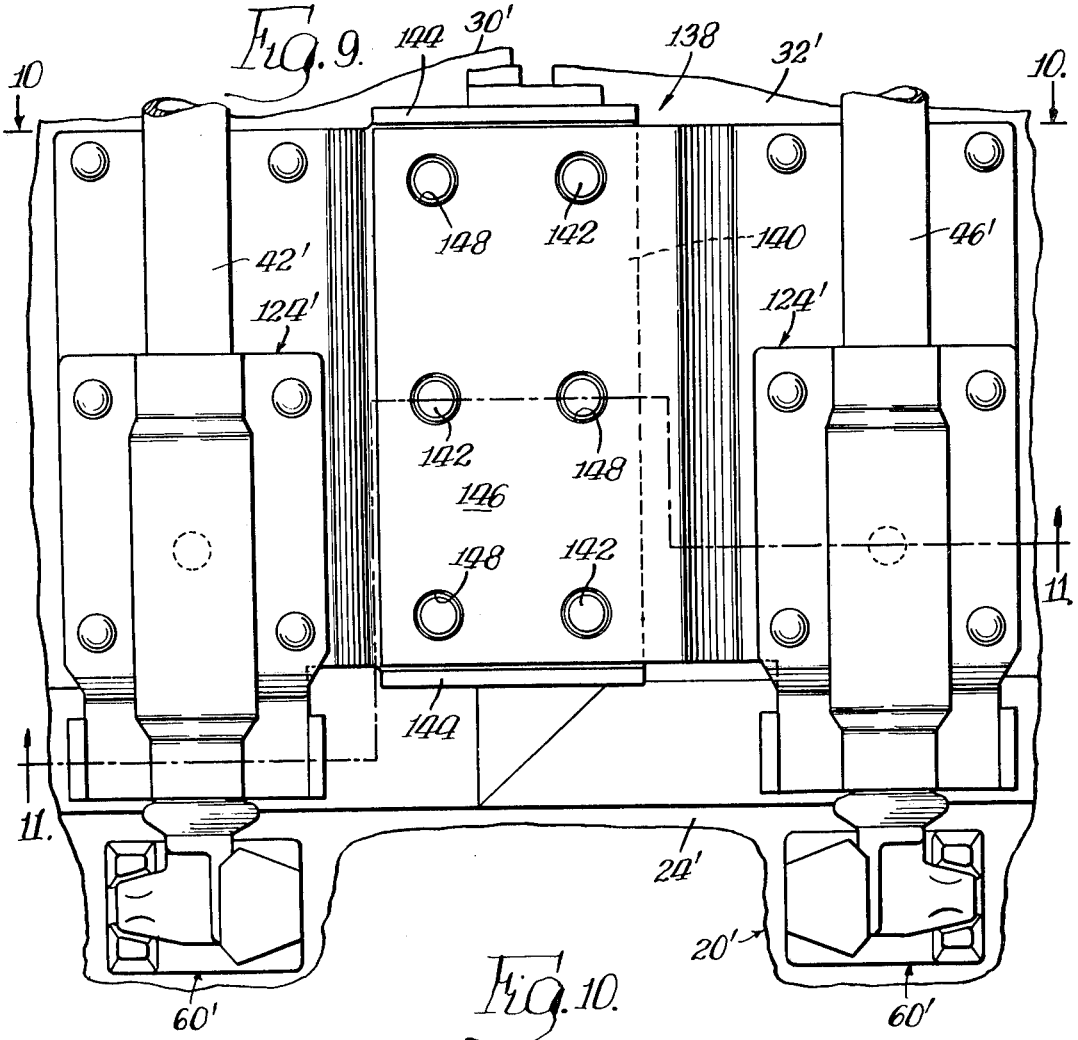
FIG. 9 is an elevational view of another embodiment of anti-racking means of the present invention.
Figure 10:
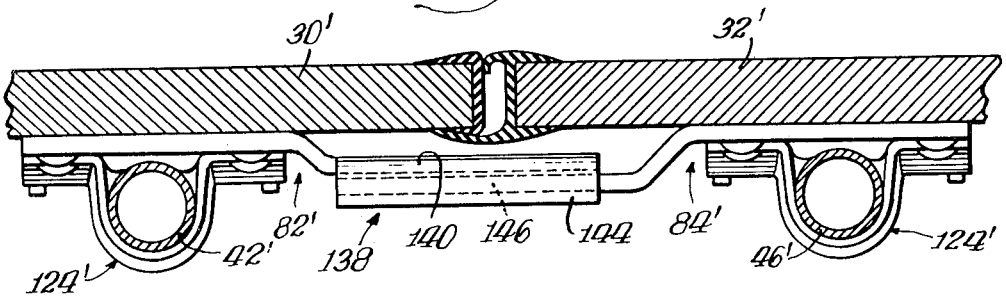
FIG. 10 is a horizontal sectional view taken substantially along the line 10—10 in FIG. 9 looking generally in the direction indicated by the arrows.
Figure 11:
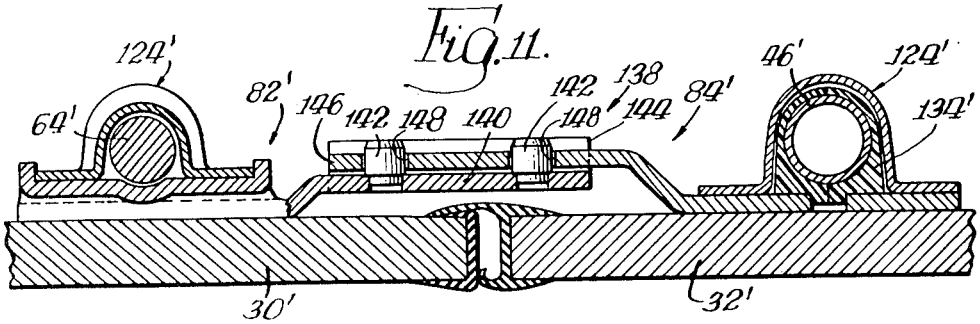
FIG. 11 is a horizontal sectional view taken substantially along the line 11—11 in FIG. 9 looking generally in the direction indicated by the arrows.
Figure 17:
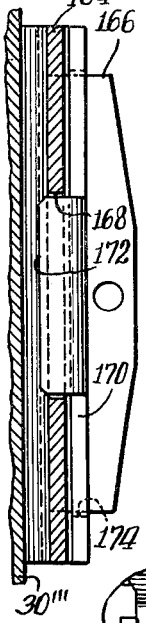
FIG. 17 is a vertical sectional view taken substantially along the line 17—17 in FIG. 16 looking generally in the direction indicated by the arrows.
Figure 16:
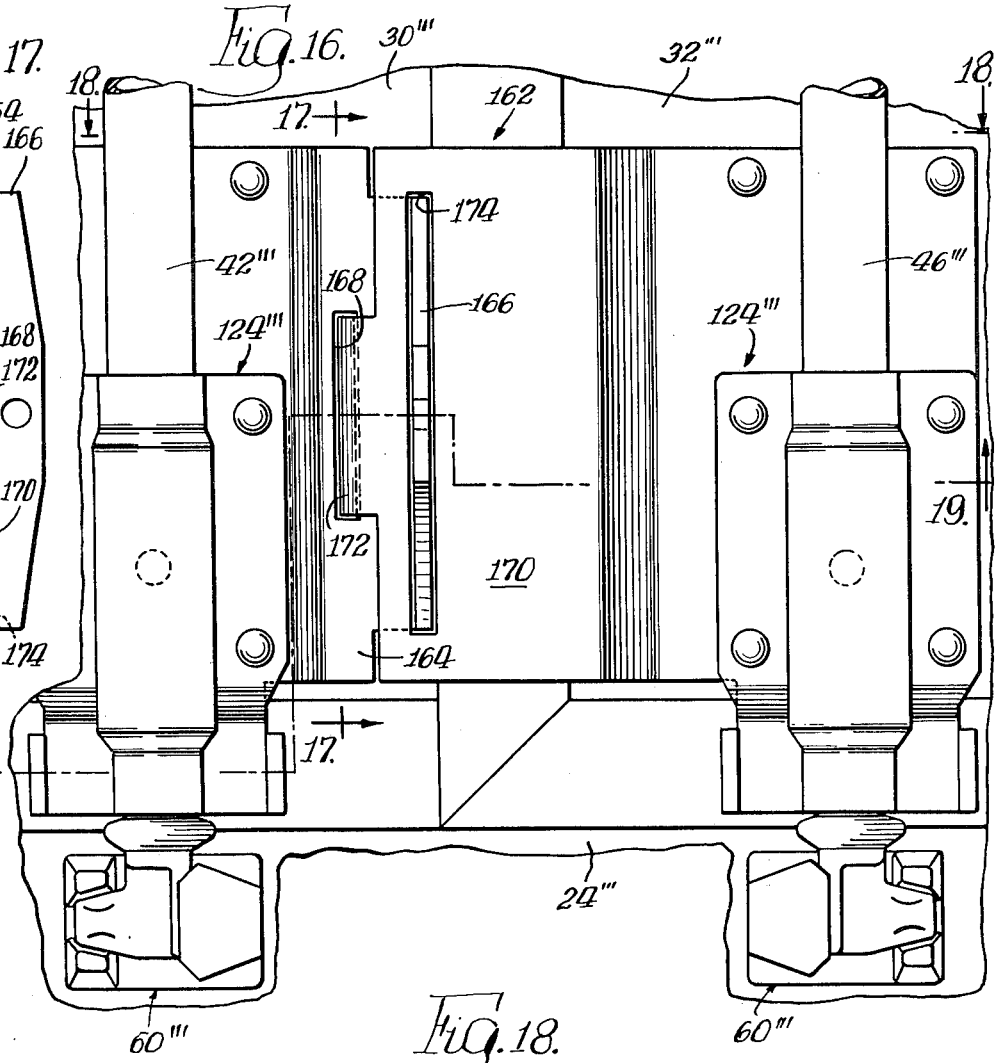
FIG. 16 is an elevational view of a still further embodiment of anti-racking means of the present invention.
Figure 18:
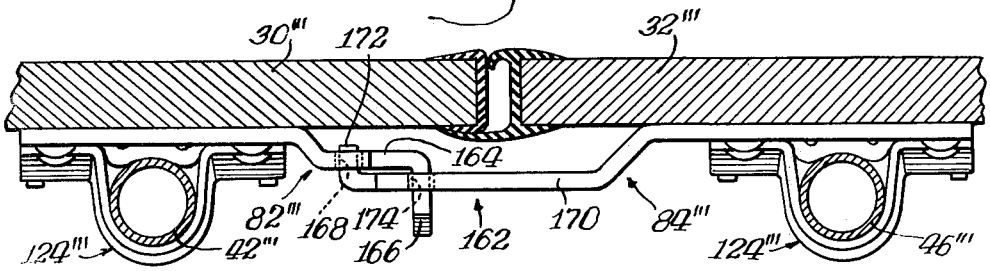
FIG. 18 is a horizontal sectional view taken substantially along the line 18—18 in FIG. 16 looking generally in the direction indicated by the arrows.
Figure 19:
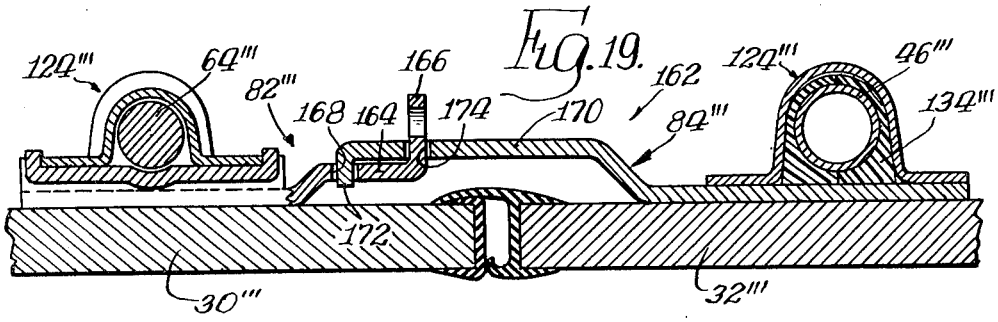
FIG. 19 is a horizontal sectional view taken substantially along the line 19—19 in FIG. 16 looking generally in the direction indicated by the arrows.

Referring now to FIGS. 9–11, there is shown another embodiment of combined anti-racking and rotary bar guide means 138. Primed reference numerals have been used in FIGS. 9–11 to identify those elements which are the same or similar to the correspondingly unprimed numbered elements shown in FIGS. 1–8. The anti-racking means 138 is substantially identical in construction and operation to the antiracking means 62, except for the interengageable means. In this connection, the side portion 140 of the bracket 82' has secured therein a plurality of pins or rivets 142, and is formed with a pair of vertically spaced horizontally oriented flanges 144, extending perpendicular to the plane of the door 30'; and the side portion 146 of the bracket 84' is formed with a plurality of apertures 148 having an orientation corresponding to that of the pins 142. As the side portions 140 and 146 are disposed in overlapping relation, the apertures 148 are engaged over the pins 142, while the side portion 146 is engaged between the flanges 144. When the brackets 82' and 84' are thus interengaged, they reinforce the doors and door frame, like the interengaged brackets 82 and 84, for resisting racking forces imposed thereon.

Referring now to FIGS. 12–15, there is shown a further embodiment of combined anti-racking and rotary bar guide means 150. Double-primed reference numerals have been used in FIGS. 12–15 to identify those elements which are the same or similar to the correspondingly unprimed numbered elements shown in FIGS. 1–8. The anti-racking means 150 is substantially identical in construction and operation to the anti-racking means 62, except for the interengageable means. In this connection, the side portion 152 of the bracket 82'' is formed with a vertically oriented tongue or projection 154, and a pair of vertically spaced horizontally oriented flanges or projections 156, extending perpendicular to the plane of the door 30''; and the side portion 158 of the bracket 84'' is formed with a vertically oriented aperture 160. As the side portions 152 and 158 are disposed in overlapping relation, the aperture 160 is engaged over the tongue 154, while the side portion 158 is engaged between the flanges 156. When the brackets 82'' and 84'' are thus interengaged, they reinforce the doors and door frame, like the interengaged brackets 82 and 84, for resisting racking forces imposed thereon.

Referring now to FIGS. 16–19, there is shown a still further embodiment of combined anti-racking and rotary bar guide means 162. Triple-primed reference numerals have been used in FIGS. 16–19 to identify those elements which are the same or similar to the correspondingly unprimed numbered elements shown in FIGS. 1–8. The anti-racking means 162 is substantially identical in construction and operation to the anti-racking means 62, except for the interengageable means. In this connection, the side portion 164 of the bracket 82''' is formed with a vertically oriented tongue 166 extending perpendicular to the plane of the door 30''', and a vertically oriented aperture 168 parallel to the tongue 166; and the side portion 170 of the bracket 84''' is formed with a vertically oriented tongue 172 extending perpendicular to the plane of the door 32''', and a vertically oriented aperture 174 parallel to the tongue 172. As the side portions 164 and 170 are disposed in overlapping relation, the aperture 174 is engaged over the tongue 166, while the tongue 172 is engaged in the aperture 168. When the brackets 82''' and 84''' are thus interengaged, they reinforce the doors and door frame, like the interengaged brackets 82 and 84, for resisting racking forces imposed thereon.

While there have been shown and described preferred embodiments of the present invention, it will be understood by those skilled in the art that various rearrangements and modifications may be made therein without departing from the spirit and scope of the invention.

The invention claimed is:

1. In an apparatus including anti-racking means for use with a door frame, a pair of doors vertically hinged to the frame and presenting free edges which are adjacently located when the doors are in closed position, and rotary bar door locking mechanism, said anti-racking means comprising a first bracket having a base portion secured to one of the doors and having a side portion adjacent the free edge of the door, a second bracket having a base portion secured to the other door and having a side portion adjacent the free edge of said other door, said side portions of said brackets being provided with interengageable means, said side portions of said backets being disposed in overlapping relationship when the doors are in closed position, and said interengageable means being interengaged when the doors are in closed position for reinforcing the doors and the door frame, the improvement comprising:

said side portion of a first of said brackets being formed with a vertically oriented tongue extending perpendicular to the plane of the one door, and a vertically oriented aperture; and said side portion of the second of said brackets being formed with a vertically oriented tongue extending perpendicular to the plane of the other door, and a vertically oriented aperture; said tongue of said first bracket being interengaged with said aperture of said second bracket, and said tongue of said second bracket being interengaged with said aperture of said first bracket, when the doors are in closed position.

2. In an apparatus as set forth in claim 1 and wherein the rotary bar door locking mechanism includes an annular collar on the rotary bar, the further improvement comprising:

one of said brackets serving as a backing plate for the rotary door closing bar; a mating front guide plate connected with said one bracket and having a generally semicylindrical vertically disposed central portion whereby to accommodate a portion of the rotary door locking bar between said front guide plate and said one bracket; slot means provided in said one bracket for receiving a portion of the annular collar of the rotary door locking bar.

* * * * *

UNITED STATES PATENT AND TRADEMARK OFFICE

CERTIFICATE OF CORRECTION

PATENT NO. : 4,068,409

DATED : January 17, 1978

INVENTOR(S) : Clarence E. White

It is certified that error appears in the above-identified patent and that said Letters Patent are hereby corrected as shown below:

Column 1, line 6, a comma should be inserted before "Filed".
Column 1, line 10, "antiracking" should read --anti-racking--.
Column 2, lines 7-8, "antiracking" should read --anti-racking--.
Column 3, line 28, "end" should read --ends--.
Column 4, line 18, "and", first occurrence, should read --or--.
Column 5, lines 13-14, "antiracking" should read --anti-racking--.
Column 5, line 43, "antiracking" should read --anti-racking--.
Column 8, line 4, "semicylindrical" should read --semi-cylindrical--.

Signed and Sealed this

*Twenty-third* Day of *May 1978*

[SEAL]

*Attest:*

RUTH C. MASON
*Attesting Officer*

LUTRELLE F. PARKER
*Acting Commissioner of Patents and Trademarks*